US006677534B2

(12) United States Patent
Yamamoto et al.

(10) Patent No.: US 6,677,534 B2
(45) Date of Patent: Jan. 13, 2004

(54) DOUBLE-LATERALLY-WOUND TWO-CORE PARALLEL EXTRAFINE COAXIAL CABLE

(75) Inventors: Yuuki Yamamoto, Tokyo (JP); Satoshi Ueno, Tokyo (JP); Hiroo Tanaka, Tokyo (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 10/162,203

(22) Filed: Jun. 5, 2002

(65) Prior Publication Data

US 2003/0024728 A1 Feb. 6, 2003

(30) Foreign Application Priority Data

Jul. 25, 2001 (JP) ..... 2001-224658

(51) Int. Cl.[7] ..... H01B 7/00; H01B 7/18

(52) U.S. Cl. ..... 174/113 R; 174/106 R

(58) Field of Search ..... 174/102 R, 106 R, 174/110 R, 113 R, 109, 108, 36, 28

(56) References Cited

U.S. PATENT DOCUMENTS 3,586,751 A * 6/1971 Schoerner ..... 174/115
4,250,351 A * 2/1981 Bridges ..... 174/106 R
4,847,448 A * 7/1989 Sato ..... 174/103
4,970,352 A * 11/1990 Satoh ..... 174/106 R
5,371,484 A * 12/1994 Nixon ..... 333/243
5,414,215 A * 5/1995 Dunand et al. ..... 174/113 R
5,463,188 A * 10/1995 Nohmi et al. ..... 174/108
5,483,020 A * 1/1996 Hardie et al. ..... 174/36
6,246,006 B1 * 6/2001 Hardin et al. ..... 174/106 R
6,495,759 B1 * 12/2002 Yamamoto et al. ..... 174/106 R
6,583,361 B2 * 6/2003 Clouet et al. ..... 174/108

* cited by examiner

*Primary Examiner*—Dean A. Reichard
*Assistant Examiner*—William H. Mayo, III
(74) *Attorney, Agent, or Firm*—Antonelli, Terry, Stout & Kraus, LLP

(57) ABSTRACT

A double-laterally-wound two-core parallel extrafine coaxial cable includes two cores, having internal conductors whose outer peripheries are covered with insulators and disposed in parallel with each other. A first laterally-wound shield is applied to the outer periphery of the two cores. A second laterally-wound shield is applied to the outer periphery of the first laterally-wound shield in a direction opposite to that of the first laterally-wound shield. A composite tape, which includes a plastic tape having a vapor-deposited metal layer formed on one surface thereof, is wound around the outer periphery of the second laterally-wound shield such that the vapor-deposited metal layer faces the second laterally-wound shield. A jacket covers the outer periphery of the composite tape. Each of the cores has a core outer diameter, and the laterally-wound shields are formed of wire having a wire diameter. The pitch of the lateral winding of the laterally wound shields is 10 to 20 times the sum of twice the core outer diameter and twice the wire diameter.

6 Claims, 8 Drawing Sheets

DOUBLE-LATERALLY-WOUND TWO-CORE PARALLEL EXTRAFINE COAXIAL CABLE

BACKGROUND OF THE INVENTION

1. Field of the Invention

The present invention relates to a two-core parallel extrafine coaxial cable having two parallel cores in which the outside peripheries of internal conductors are covered with insulators, and more particularly, to a two-core parallel extrafine coaxial cable longitudinally provided with a vapor-deposited tape that is excellent in bending characteristics and has a high shield effect and an improved shield strip property.

2. Description of the Related Art

In general, a coaxial cable increases a metal volume (shield volume) by a technology of using a braided shield and further double shields as an external shield in order to improve a shield effect. This technology is similarly used also in a two-core parallel extrafine coaxial cable having two parallel cores in which the outer peripheries of internal conductors are covered with insulators.

The two-core parallel extrafine coaxial cable is available in such an arrangement that, for example, a braided shield is applied to the outer periphery of two cores disposed in parallel with each other as an external shield, and a composite tape, which is composed of a plastic tape having a vapor-deposited copper layer of at least one $\mu$m thick formed on one surface thereof, is wound around the outer periphery of the braided shield such that the vapor-deposited copper layer faces the braided shield.

When the external shield of the extrafine coaxial cable is stripped to process a terminal, a stripping job is sequentially performed such that a jacket is stripped first, the cable is put into a solder bath and the stripped portion of the external shield is solidified with solder, a cut is made to the external shield, and then the external shield is pulled out.

In the external shield composed of the braided shield, however, a problem arises in that it is very difficult to strip the external shield because when the external shield is pulled out, the braided shield is made tight and the core is tightened thereby. Sometimes, the core may be broken. Further, in the braided shield, since wires are stranded, they greatly rub against one another, thereby an internal external conductor is liable to be broken.

A method of solving the above problem is to use a laterally-wound shield in place of the braided shield. However, this method has a problem in that a coaxial cable employing the laterally-wound shield is inferior to that employing the braided shield in the shield effect because a shield volume is small.

SUMMARY OF THE INVENTION

Accordingly, an object of the present invention is to provide a two-core parallel extrafine coaxial cable longitudinally provided with a vapor-deposited tape that is excellent in bending characteristics and has a high shield effect and an improved shield strip property.

The present invention has been devised to achieve the above object.

According to a first aspect of the invention, a double-laterally-wound two-core parallel extrafine coaxial cable is composed of two cores having internal conductors whose outer peripheries are covered with insulators and disposed in parallel with each other, a first laterally-wound shield applied to the outer periphery of the two cores, a second laterally-wound shield applied to the outer periphery of the first laterally-wound shield in a direction opposite to that of the first laterally-wound shield, a composite tape, which is composed of a plastic tape having a vapor-deposited metal layer formed on one surface thereof, wound around the outer periphery of the second laterally-wound shield such that the vapor-deposited metal layer faces the second laterally-wound shield, and a jacket covering the outer periphery of the composite tape.

According to a second aspect of the invention, a double-laterally-wound two-core parallel extrafine coaxial cable is composed of two cores having internal conductors whose outer peripheries are covered with insulators and disposed in parallel with each other, a first laterally-wound shield applied to the outer periphery of the two cores, a second laterally-wound shield applied to the outer periphery of the first laterally-wound shield in a direction opposite to that of the first laterally-wound shield, a composite tape, which is composed of a plastic tape having vapor-deposited metal layers formed on both the surfaces thereof, wound around the outer periphery of the second laterally-wound shield, and a jacket covering the outer periphery of the composite tape.

According to a third aspect of the invention, a double-laterally-wound two-core parallel extrafine coaxial cable is composed of two cores having internal conductors whose outer peripheries are covered with insulators and disposed in parallel with each other, a first laterally-wound shield applied to the outer periphery of the two cores, a second laterally-wound shield applied to the outer periphery of the first laterally-wound shield in the same direction as that of and at a pitch different from that of the first laterally-wound shield, a composite tape, which is composed of a plastic tape having a vapor-deposited metal layer formed on one surface thereof, wound around the outer periphery of the second laterally-wound shield such that the vapor-deposited metal layer faces the second laterally-wound shield, and a jacket covering the outer periphery of the composite tape.

According to a fourth aspect of the invention, a double-laterally-wound two-core parallel extrafine coaxial cable is composed of two cores having internal conductors whose outer peripheries are covered with insulators and disposed in parallel with each other, a first laterally-wound shield applied to the outer periphery of the two cores, a second laterally-wound shield applied to the outer periphery of the first laterally-wound shield in the same direction as that of and at a pitch different from that of the first laterally-wound shield, a composite tape, which is composed of a plastic tape having vapor-deposited metal layers formed on both the surfaces thereof, wound around the outer periphery of the second laterally-wound shield, and a jacket covering the outer periphery of the composite tape.

It is preferable that the internal conductors of the cores have an outside diameter of about 0.13 mm or less and an outside diameter of 1.0 mm or less in a long axis direction when the cable is covered with the jacket.

It is preferable that vapor-deposited metal layer formed on the composite film be composed of one of silver and copper and have a thickness of 0.1 $\mu$m or more.

DESCRIPTION OF THE PREFERRED EMBODIMENTS

Preferable embodiments of the present invention will be described below with reference to the accompanying drawings.

Figure 1:
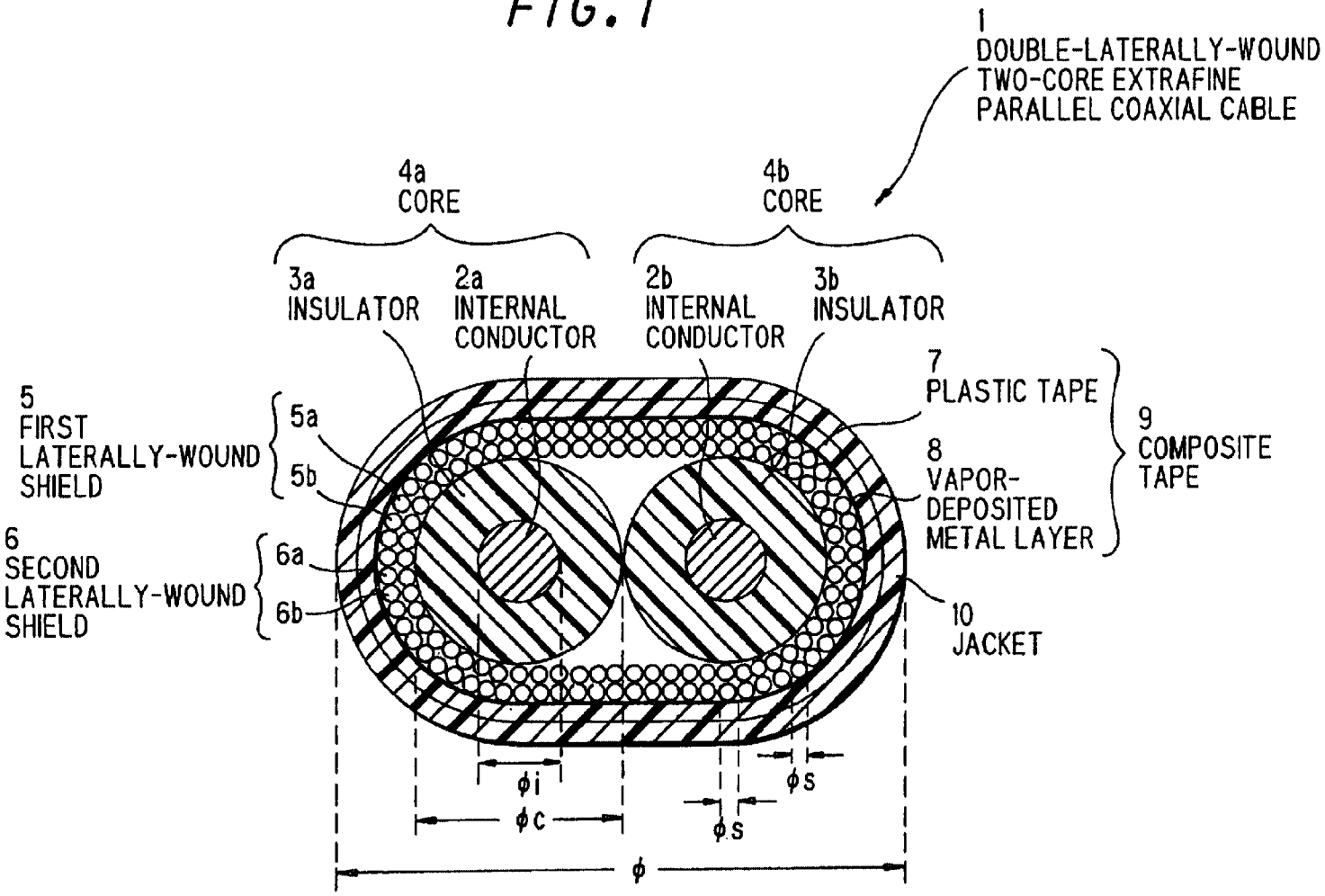
FIG. 1 is a sectional view showing a double-laterally-wound two-core parallel extrafine coaxial cable of a preferable embodiment of the present invention.
Figure 2:
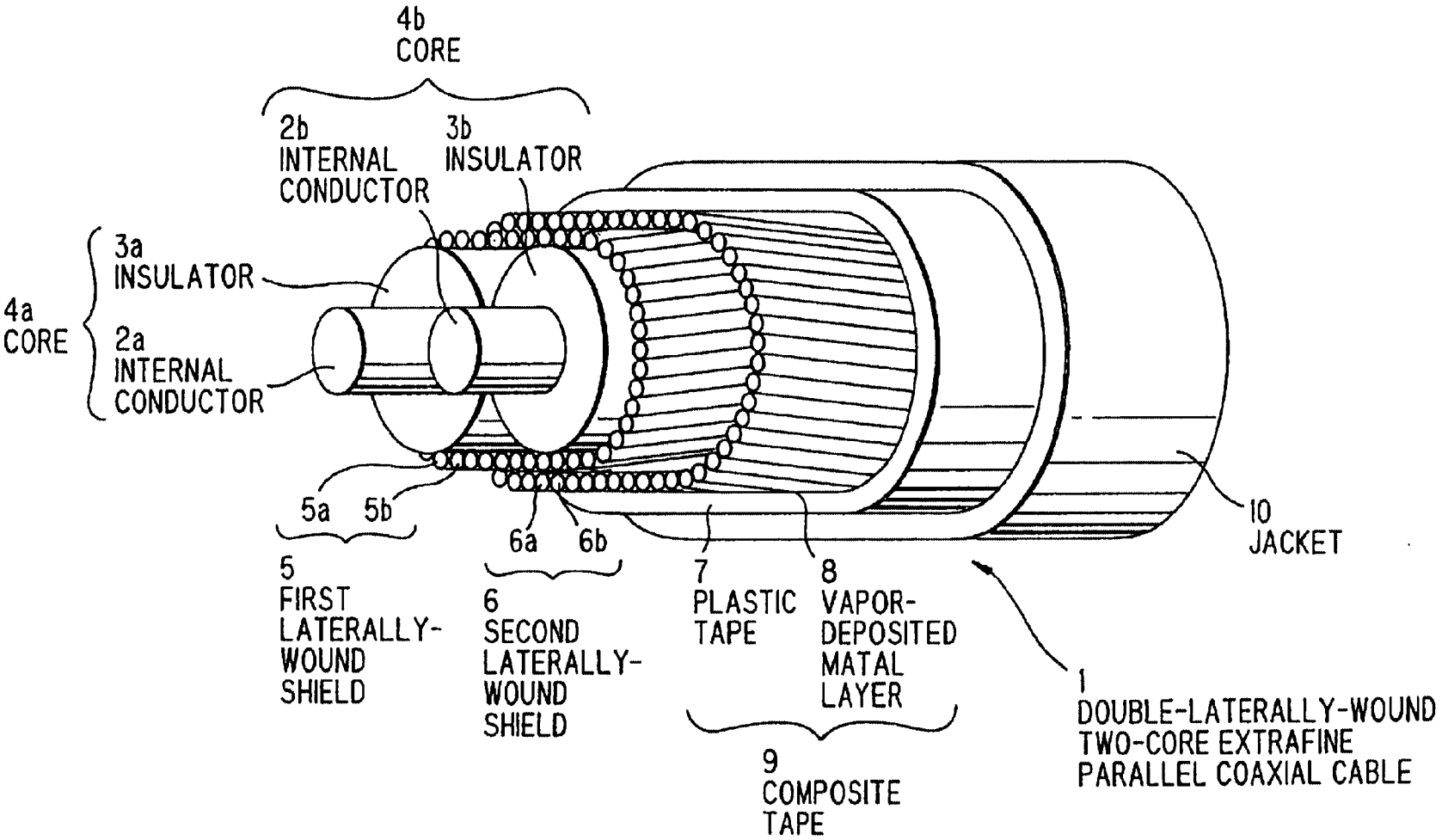
FIG. 2 is a structural view of the double-laterally-wound two-core parallel extrafine coaxial cable shown in FIG. 1.

FIG. 1 shows a sectional view of a double-laterally-wound two-core parallel extrafine coaxial cable as a preferable embodiment of the present invention. FIG. 2 shows a structural view of the double-laterally-wound two-core parallel extrafine coaxial cable shown in FIG. 1.

As shown in FIGS. 1 and 2, the double-laterally-wound two-core parallel extrafine coaxial cable 1 according to the present invention is used as a cable that is wired in a narrow space such as the hinge portion of a notebook computer and more particularly used to connect the main body of the notebook computer to a liquid crystal screen through the hinge portion.

The double-laterally-wound two-core parallel extrafine coaxial cable 1 is composed of two parallel cores 4*a* and 4*b* having internal conductors 2*a* and 2*b* whose outer peripheries are covered with insulators 3*a* and 3*b*, respectively, a first laterally-wound shield 5 applied to the outer periphery of the cores 4*a* and 4*b*, a second laterally-wound shield 6 applied to the outer periphery of the first laterally-wound shield 5 in a direction opposite to that of the first laterally-wound shield 5, a composite tape 9 that is composed of a plastic tape 7 having a vapor-deposited metal layer 8 formed on one surface thereof and is wound around the outer periphery of the cores 4*a* and 4*b* such that the vapor-deposited metal layer 8 faces the second laterally-wound shield 6, and a jacket 10 covering the outer periphery of the composite tape 9.

The internal conductors 2*a* and 2*b* are composed of a single wire conductor formed of, for example, a soft copper wire, a tin-plated soft copper wire, a silver-plated copper alloy wire, and the like or of a stranded wire conductor made by stranding the single wires and have an outside diameter $\phi$ i of about 0.13 mm or less. In other words, the outside diameter $\phi$ i of the internal conductors 2*a* and 2*b* is 36 AWG (American Wire Gauge) or less.

The insulators 3*a* and 3*b* are composed of a resin selected from, for example, polyethylene, polypropylene, copolymer of ethylene and tetrafluoroethylene (ETFE), copolymer of tetrafluoroethylene and hexafluiropropylene (FEP), polytetrafluoroethylene (PTFE) resin, copolymer of tetrafluoroethylene and perfluoroalkoxy (PFA), and fluorine-containing rubber.

The cores 4*a* and 4*b* may be formed around the outer peripheries of the internal conductors 2*a* and 2*b* by extruding any of the aforementioned resins in a uniform thickness by an extruder, or the like so as to cover the internal conductors 2*a* and 2*b*, or may be formed by winding a tape composed of any of the resins around the outer peripheries thereof. The outside diameter $\phi$ c of the respective cores 4*a* and 4*b* is about 0.42 mm or less.

Incidentally, the first laterally-wound shield 5 acting as an external shield is applied to the outer periphery of the two cores 4*a* and 4*b* disposed in parallel with each other. The first laterally-wound shield 5 is formed by laterally winding a multiplicity (for example, 30 to 60) of wires 5*a*, 5*b*, . . . each composed of, for example, a soft copper wire, a tin-plated soft copper wire, a silver-plated copper alloy wire, or the like at a predetermined pitch. The diameter $\phi$ s of the respective wires 5*a*, 5*b*, . . . forming the laterally-wound shield 5 is about 0.03 mm.

The second laterally-wound shield 6 acting as an external shield is applied to the outer periphery of the first laterally-wound shield 5 in a direction opposite to that of the first laterally-wound shield 5. The second laterally-wound shield 6 is also formed by laterally winding a multiplicity (for example, 30 to 60) of wires 6*a*, 6*b*, . . . each composed of, for example, a soft copper wire, a tin-plated soft copper wire, a silver-plated copper alloy wire, or the like at a predetermined pitch. The diameter $\phi$s of the respective wires 6*a*, 6*b*, . . . forming the laterally-wound shield 6 is about 0.03 mm.

The laterally-winding pitch of the laterally-wound shields 5 and 6 is determined in consideration of that a larger laterally-winding pitch results in an inferior shield effect because the continuous slit between the respective wires 5*a*, 5*b* . . . , and 6*a*, 6*b* . . . are increased and that a smaller laterally-winding pitch results in the twist of the cable 1 itself that is caused by the tension of the respective wires 5*a*, 5*b* . . . , 6*a*, 6*b* . . . when they are made while the slit between the respective wires 5*a*, 5*b* . . . , 6*a*, 6*b* . . . are reduced. More specifically, it is preferable to set the laterally-winding pitch to 10 to 20 times the sum of twice the core outside diameter $\phi$c and twice the wire diameter $\phi$s.

The composite tape 9, which is composed of the plastic tape 7 of, for example, polyester, or the like having the vapor-deposited metal layer 8 formed on the one surface thereof, is wound around the outer periphery of the second laterally-wound shield 6. The composite tape 9 is wound around the outer periphery of the second laterally-wound shield 6 such that the vapor-deposited metal layer 8 faces the second laterally-wound shield 6. The vapor-deposited metal layer 8 is composed of, for example, copper or silver. The vapor-deposited metal layer 8 has a thickness of at least 0.1 $\mu$m.

The jacket 10 is composed of a resin selected from, for example, polyvinyl chloride (PVC), polyethylene, polypropylene, copolymer of ethylene and tetrafluoroethylene (ETFE), copolymer of tetrafluoroethylene and hexafluiropropylene (FEP), polytetrafluoroethylene (PTFE) resin, copolymer of tetrafluoroethylene and perfluoroalkoxy (PFA), and fluorine-containing rubber.

The jacket 10 is composed of any of the above resins extruded around the outer periphery of the composite tape 9 in a uniform thickness by an extruder, or the like. A plastic tape of, for example, polyester, or the like may be used as the jacket 10. In this case, the plastic tape is wound around the outer periphery of the composite tape 9 in a superimposed state.

The outside diameter $\phi$ of the double-laterally-wound two-core parallel extrafine coaxial cable 1 is set to 1.0 mm or less when it is covered with the jacket 10.

A feature of the present invention resides in that the laterally-wound shields are applied doubly to the outer periphery of the cores disposed in parallel with each other, that is, these shields are arranged as the two-layer structure composed of the first and second laterally-wound shields. A shield effect is improved by the double laterally-wound shields, thereby an excellent shield strip property can be achieved by permitting the laterally-wound shields to be easily untied when a terminal of the cable is processed. Further, the double laterally-wound shields are excellent in bending characteristics because the metal volume (shield volume) thereof is smaller than that of a braided shield.

Next, an example of a process for manufacturing the double-laterally-wound two-core parallel extrafine coaxial cable 1 will be described.

First, a silver-plated copper alloy wire having an outside diameter ϕi of about 0.09 mm (40 AWG) is used as the internal conductors 2*a* and 2*b*. PFA resin insulators, which are formed by extruding a PFA resin by an extruder and act as the insulators 3*a* and 3*b*, are disposed around the outer peripheries of the respective internal conductors 2*a* and 2*b* so as to cover them, thereby the cores 4*a* and 4*b* each having an outside diameter ϕc of 0.21 mm are made. The two cores 4*a* and 4*b* acting as insulated wires are disposed in parallel with each other.

The first laterally-wound shield 5 is composed of 40 silver-plated copper alloy wires acting as the wires 5*a*, 5*b*, . . . each of which has a wire diameter ϕs of 0.03 mm and which are laterally spirally wound around the outer periphery of the cores 4*a* and 4*b* disposed in parallel with each other at a pitch of 6 mm.

The second laterally-wound shield 6 is composed of 44 silver-plated copper alloy wires acting as the wires 6*a*, 6*b*, . . . each having a wire diameter ϕs of 0.03 mm which are spirally laterally wound around the outer periphery of the first laterally-wound shield at a pitch of 6 mm in a direction opposite to that of the first laterally-wound shield 5.

A copper-deposited polyester film, which has a thickness of about 4 μm and a width of 2.5 mm and acts as the composite tape 9, is wound around the outer periphery of the second laterally-wound shield 6. The copper-deposited polyester film is composed of a polyester film having a vapor-deposited copper layer of about 0.3 μm thick formed on the one surface thereof. The polyester film acts as the plastic tape 7, and the vapor-deposited copper layer acts as the vapor-deposited metal layer 8. The composite tape 9 is wound such that the ½ to ⅓ portion thereof is superimposed each other and that the vapor-deposited copper layer faces the second laterally-wound shield 6.

Then, the double-laterally-wound two-core parallel extrafine coaxial cable 1 shown in FIGS. 1 and 2 is finished by winding a polyester film of about 0.65 μm thick and 2.5 mm wide acting as the jacket 10 around the outer periphery of the composite tape 9 with the ½ to ⅓ portion thereof superimposed each other. The cable 1 has a finished outside diameter (an outside diameter in a long axis direction when it is covered with the jacket) ϕ of about 0.55 mm.

As described above, the double-laterally-wound two-core parallel extrafine coaxial cable 1 according to the present invention has a high shield effect because the metal volume (shield volume) is increased by the laterally-wound double shields. In particular, since the first and second laterally-wound shields 5 and 6 are applied in the opposite directions each other, it is possible to make the slit formed between the respective wires 5*a*, 5*b*, . . . and wires 6*a* and 6*b*, . . . as small as possible, thereby a shield effect as high as that of the external shield composed of a braided shield can be exhibited.

The finished outside diameter (the outside diameter in the long axis direction when it is covered with the jacket) of the cable 1 is 1.0 mm or less, that is, the cable is extrafine, and further has the sufficient shield effect. Accordingly, the cable can be used as wiring in a narrow space such as the hinge portion of a recent notebook personal computer used in a high frequency of, for example, at least 10 MHz. More specifically, it can be used as a cable for connecting the main body of the notebook personal computer to a liquid crystal screen through the hinge portion.

To strip the external shield for terminal processing, a stripping job is sequentially performed such that a jacket is stripped first, the cable is put into a solder bath and the stripped portion of the external shield is solidified with solder, a cut is made to the external shield, and then the external shield is pulled out.

The external shields of the double-laterally-wound two-core parallel extrafine coaxial cable 1 according to the present invention are composed of the laterally-wound shields. Thus, when the laterally-wound shields are pulled out, the cores are not tightened, different from the case in which a braided shield is pulled out, thereby the shields can be easily stripped and the cores are not broken. This is because that since the laterally-wound shields are composed of the multiplicity of wires wound spirally and laterally, they can be easily untied laterally.

Further, since the external shields are composed of the laterally-wound shields, the flexibility of the cables, which lacks in the case in which the external shields are composed of the braided shields or the double shields, can be also improved. The finished outside diameter of the cables can be reduced as compared with the case in which the external shields are composed of the braided shield or the double shields.

Accordingly, the double-laterally-wound two-core parallel extrafine coaxial cable 1 longitudinally provided with the vapor-deposited tape according to the present invention has all of electric characteristics, a processing property, and a bending property in good balance.

Next, a second embodiment of the present invention will be described.

Figure 3:
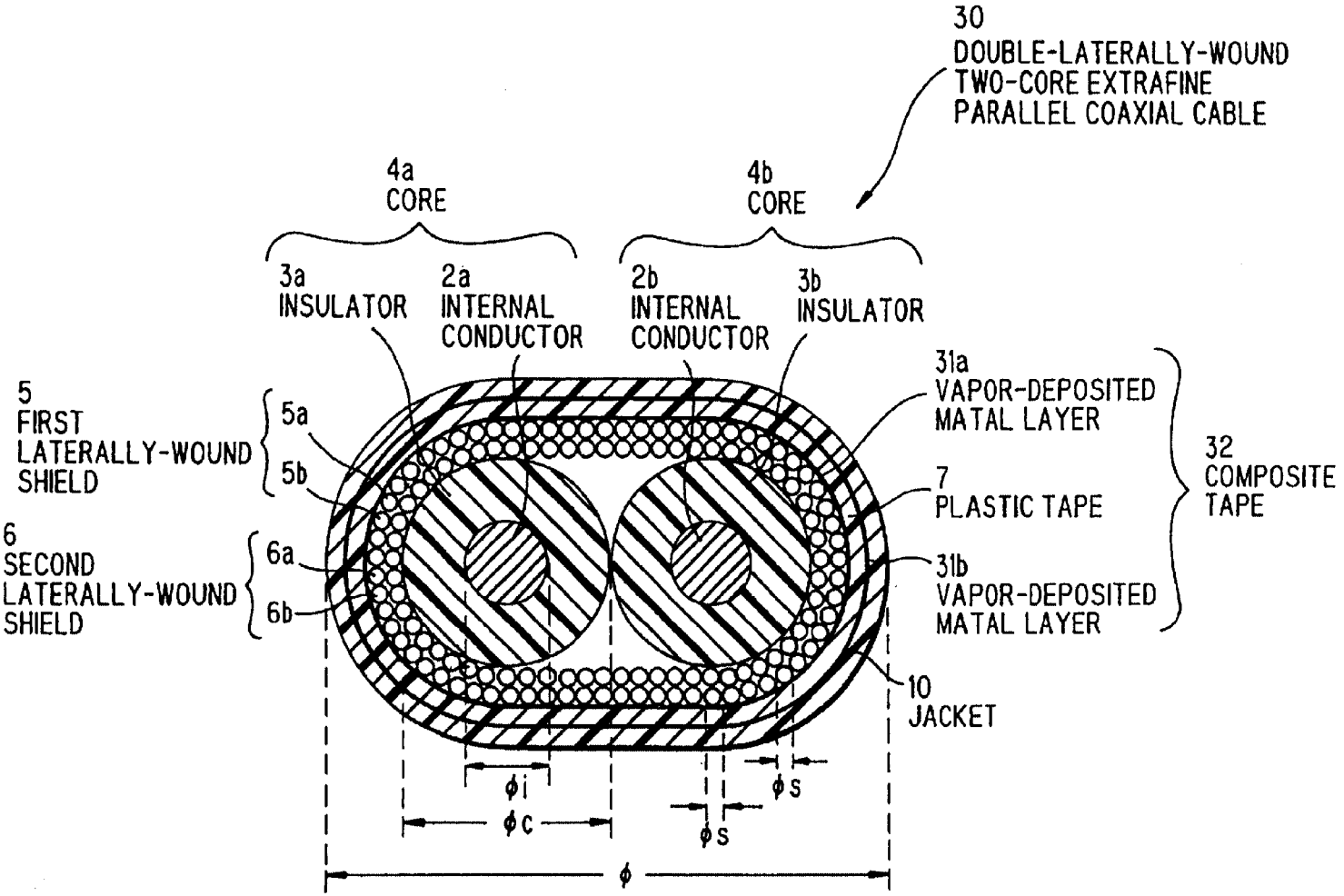
FIG. 3 is a sectional view showing a double-laterally-wound two-core parallel extrafine coaxial cable of a second embodiment of the present invention.
Figure 4:
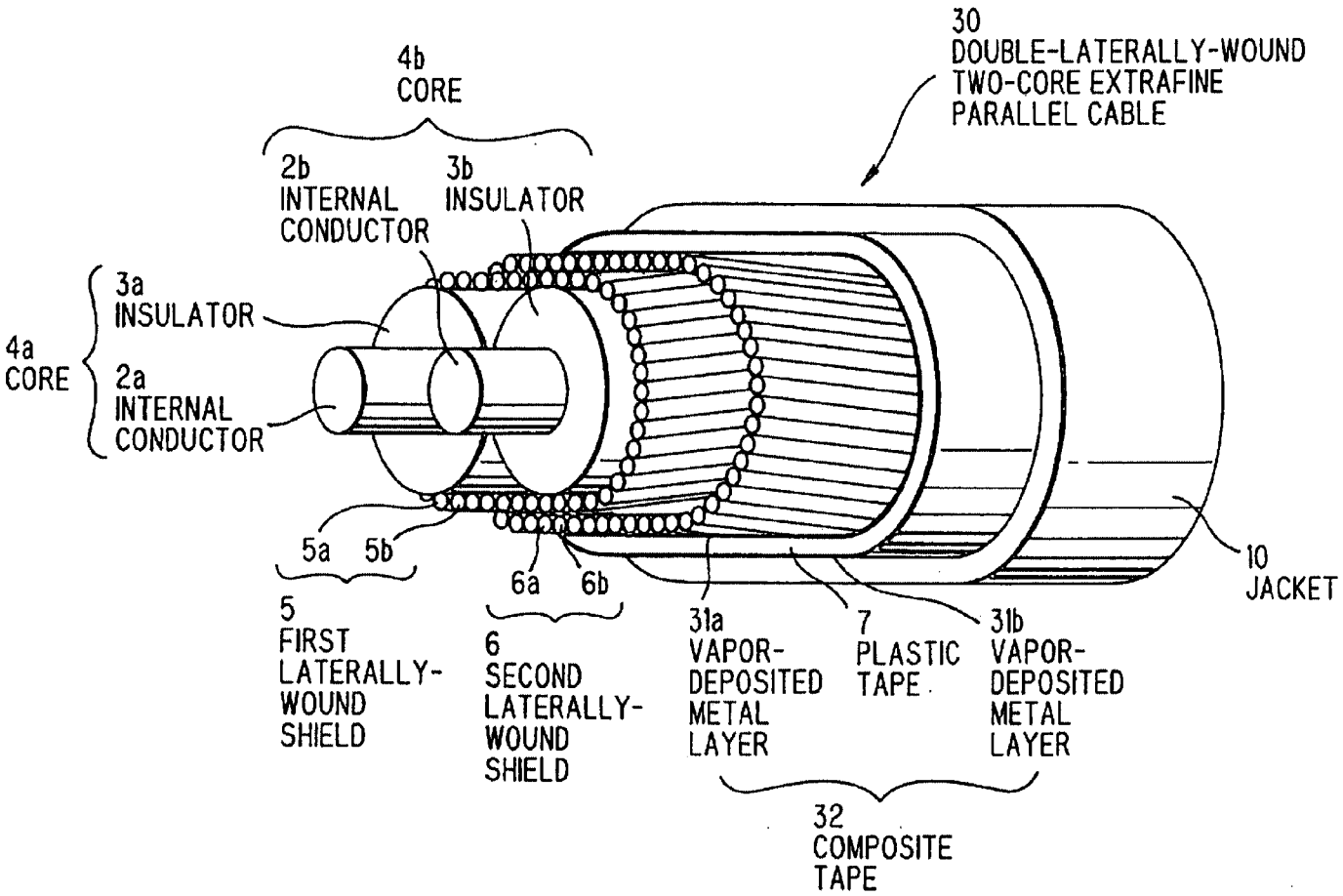
FIG. 4 is a structural view of the double-laterally-wound two-core parallel extrafine coaxial cable shown in FIG. 3.

FIG. 3 shows a sectional view of a double-laterally-wound two-core parallel extrafine coaxial cable as a second embodiment of the present invention. FIG. 4 shows a structural view of the double-laterally-wound two-core parallel extrafine coaxial cable shown in FIG. 3.

As shown in FIGS. 3 and 4, the double-laterally-wound two-core parallel extrafine coaxial cable 30 is arranged similarly to the double-laterally-wound two-core parallel extrafine coaxial cable 1 described in FIGS. 1 and 2 except that a composite tape 32, which is composed of the plastic tape 7 having vapor-deposited metal layers 31*a* and 31*b* formed on both the surfaces thereof, is wound around the outer periphery of the second laterally-wound shield 6.

The vapor-deposited metal layers 31*a* and 31*b* are composed of, for example, copper or silver and have a thickness of at least 0.1 μm.

Since the double-laterally-wound two-core parallel extrafine coaxial cable 30 has the composite tape 32 that is composed of the plastic tape 7 having the vapor-deposited metal layers 31*a* and 31*b* formed on both the surfaces thereof and is wound around the outer periphery thereof, the cable 30 has an advantage that the shield effect can be more enhanced than the cable 1. Further, since it is not necessary to confirm the front surface and the back surface of the composite tape 32 when it is wound around the outer periphery of the second laterally-wound shield 6, the cable 30 also has an advantage for preventing the composite tape 32 from being erroneously wound. The other operation/working-effect of the cable 30 is the same as that of the cable 1.

Next, a third embodiment of the present invention will be described.

Figure 5:
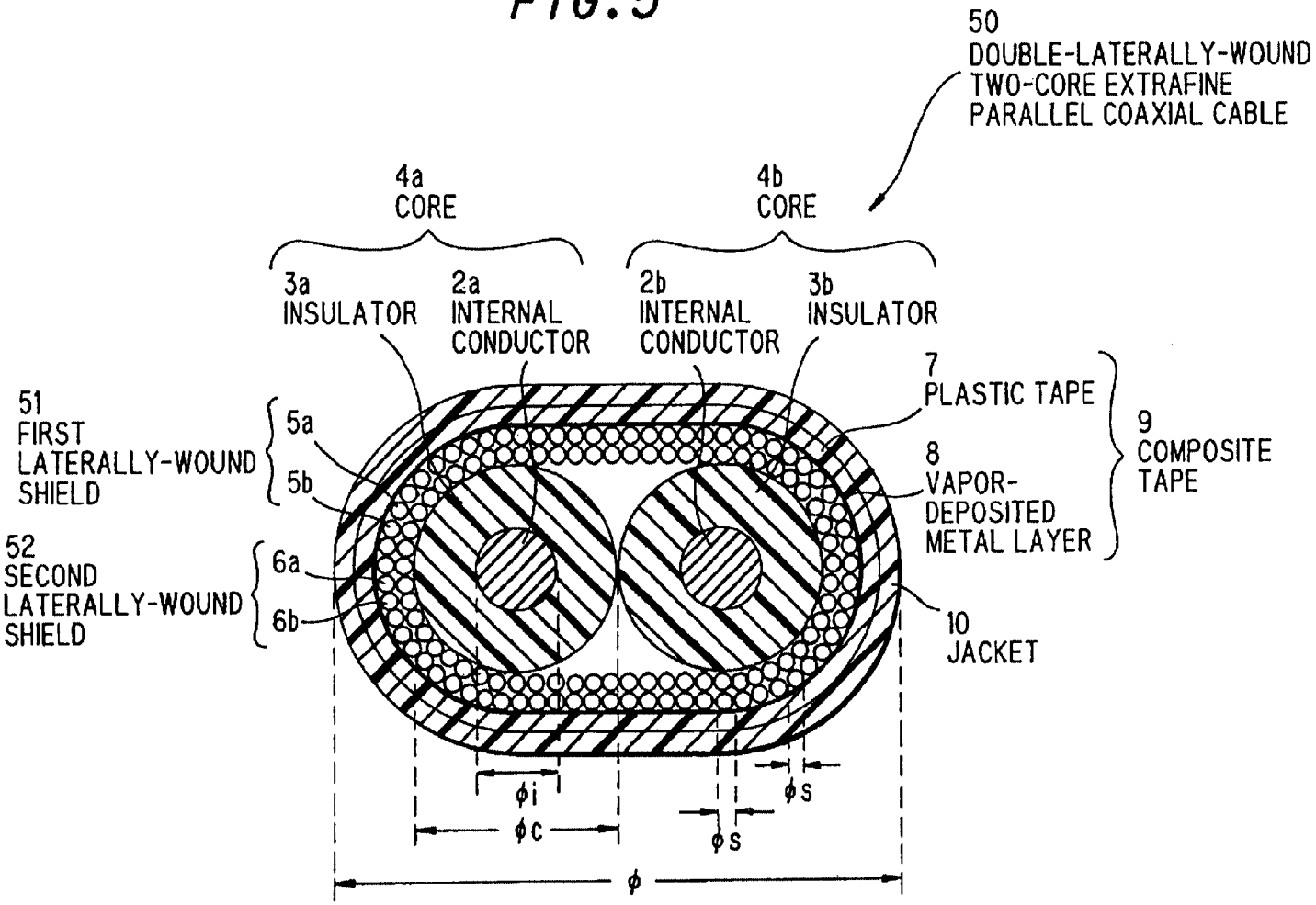
FIG. 5 is a sectional view showing a double-laterally-wound two-core parallel extrafine coaxial cable of a third embodiment of the present invention.
Figure 6:
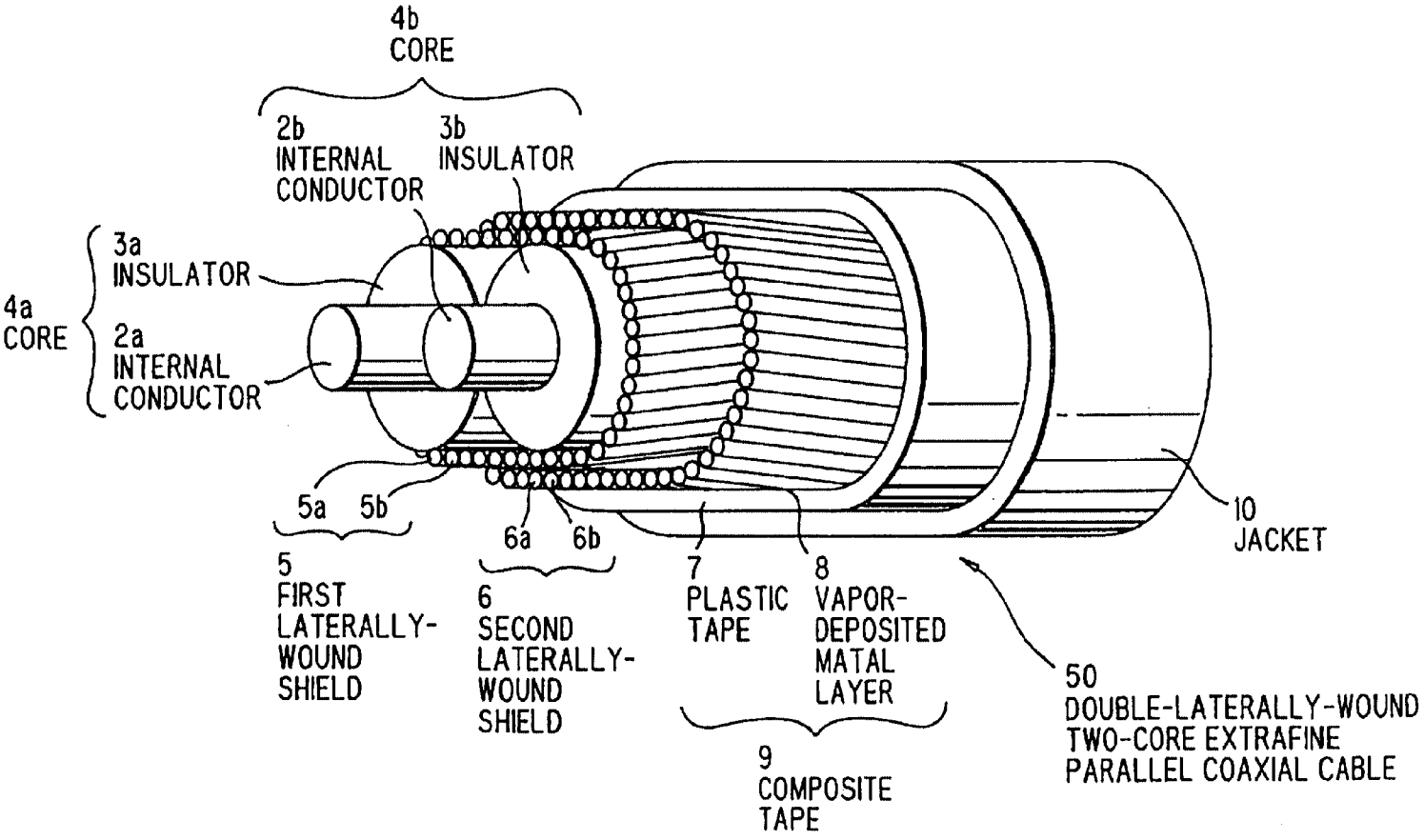
FIG. 6 is a structural view of the double-laterally-wound two-core parallel extrafine coaxial cable shown in FIG. 5.

FIG. 5 shows a sectional view of a double-laterally-wound two-core parallel extrafine coaxial cable as a third embodiment of the present invention. FIG. 6 shows a structural view of the double-laterally-wound two-core parallel extrafine coaxial cable shown in FIG. 5.

As shown in FIGS. 5 and 6, the double-laterally-wound two-core parallel extrafine coaxial cable 50 is composed of the two parallel cores 4*a* and 4*b* having the internal conductors 2*a* and 2*b* whose outer peripheries are covered with the insulators 3*a* and 3*b*, respectively, a first laterally-wound shield 51 applied to the outer periphery of the cores 4*a* and 4*b*, a second laterally-wound shield 52 applied to the outer periphery of the first laterally-wound shield 51 in the same direction as that of and at a pitch different from that of the first laterally-wound shield 51, a composite tape 9, which is composed of the plastic tape 7 having the vapor-deposited metal layer 8 formed on one surface thereof and wound around the outer periphery of the cores 4*a* and 4*b* such that the vapor-deposited metal layer 8 faces the second laterally-wound shield 52, and the jacket 10 covering the outer periphery of the composite tape 9.

The first laterally-wound shield 51 is composed of 40 silver-plated copper alloy wires acting as wires 5*a*, 5*b*, . . . each having a wire diameter ϕs of 0.03 mm which are spirally laterally wound around the outer periphery of the two parallel cores 4*a* and 4*b* at a pitch of 6 mm.

The second laterally-wound shield 52 is composed of 44 silver-plated copper alloy wires acting as the wires 6*a*, 6*b*, . . . each having a wire diameter ϕs of 0.03 mm which are spirally laterally wound around the outer periphery of the first laterally-wound shield 51 at a pitch of 5 mm in the same direction as that of the first laterally-wound shield 51. The second laterally-wound shield 52 is applied in the same direction as that of the first laterally-wound shield 51. Accordingly, the slits formed between the respective wires 5*a*, 5*b*, . . . , 6*a*, 6*b*, can be reduced in size by winding the wires 6*a*, 6*b* . . . at the pitch smaller than that of the wires 5*a*, 5*b*, . . . of the first laterally-wound shield 51.

The double-laterally-wound two-core parallel extrafine coaxial cable 50 is superior to the cables 1 and 30 described in FIGS. 1 to 4 particularly in the shield strip property and the bending characteristics while it is somewhat inferior thereto in the shield effect. This is because the first and second laterally-wound shields 51 and 52 are applied in the same direction.

Next, a fourth embodiment of the present invention will be described.

Figure 7:
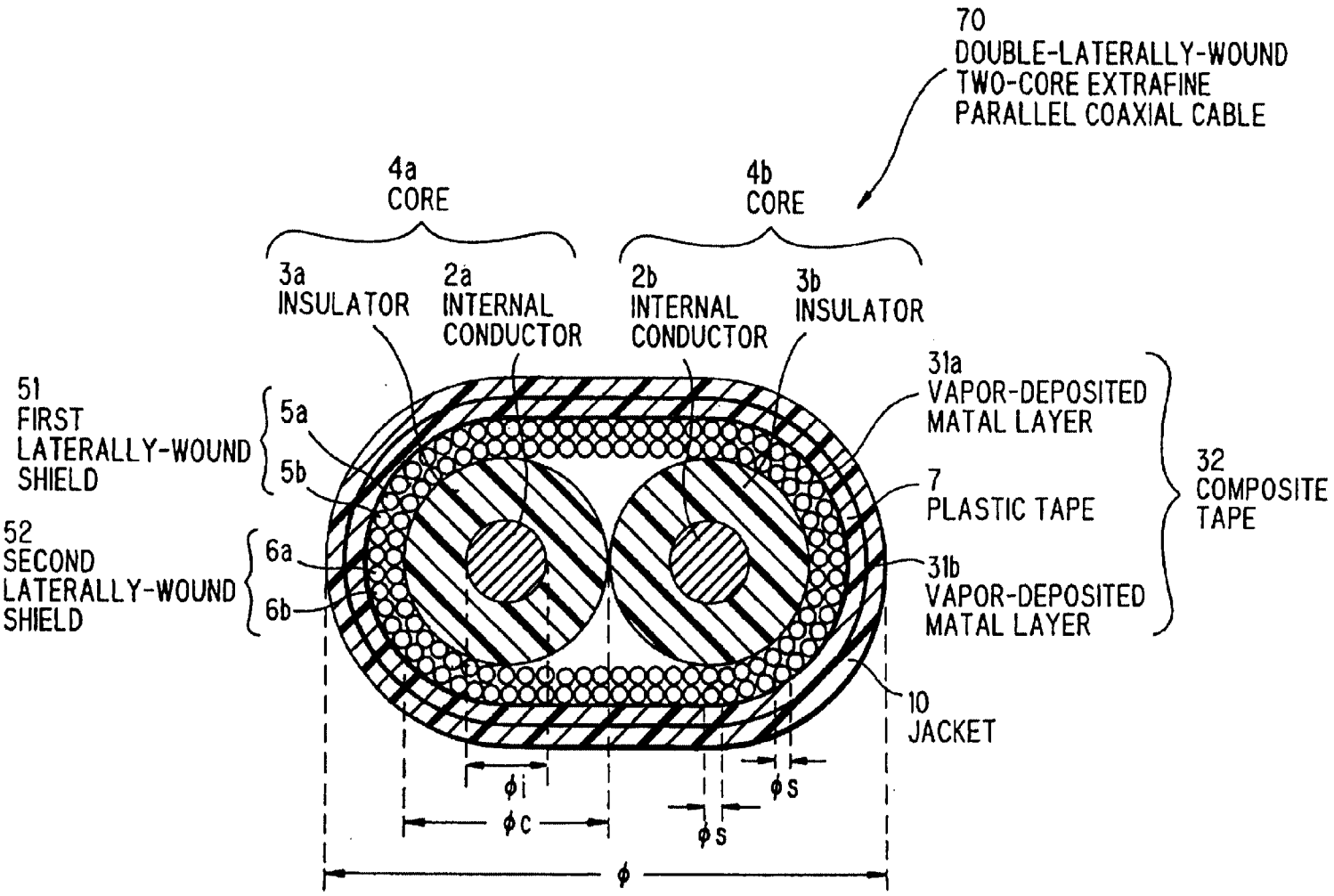
FIG. 7 is a sectional view showing a double-laterally-wound two-core parallel extrafine coaxial cable of a fourth embodiment of the present invention.
Figure 8:
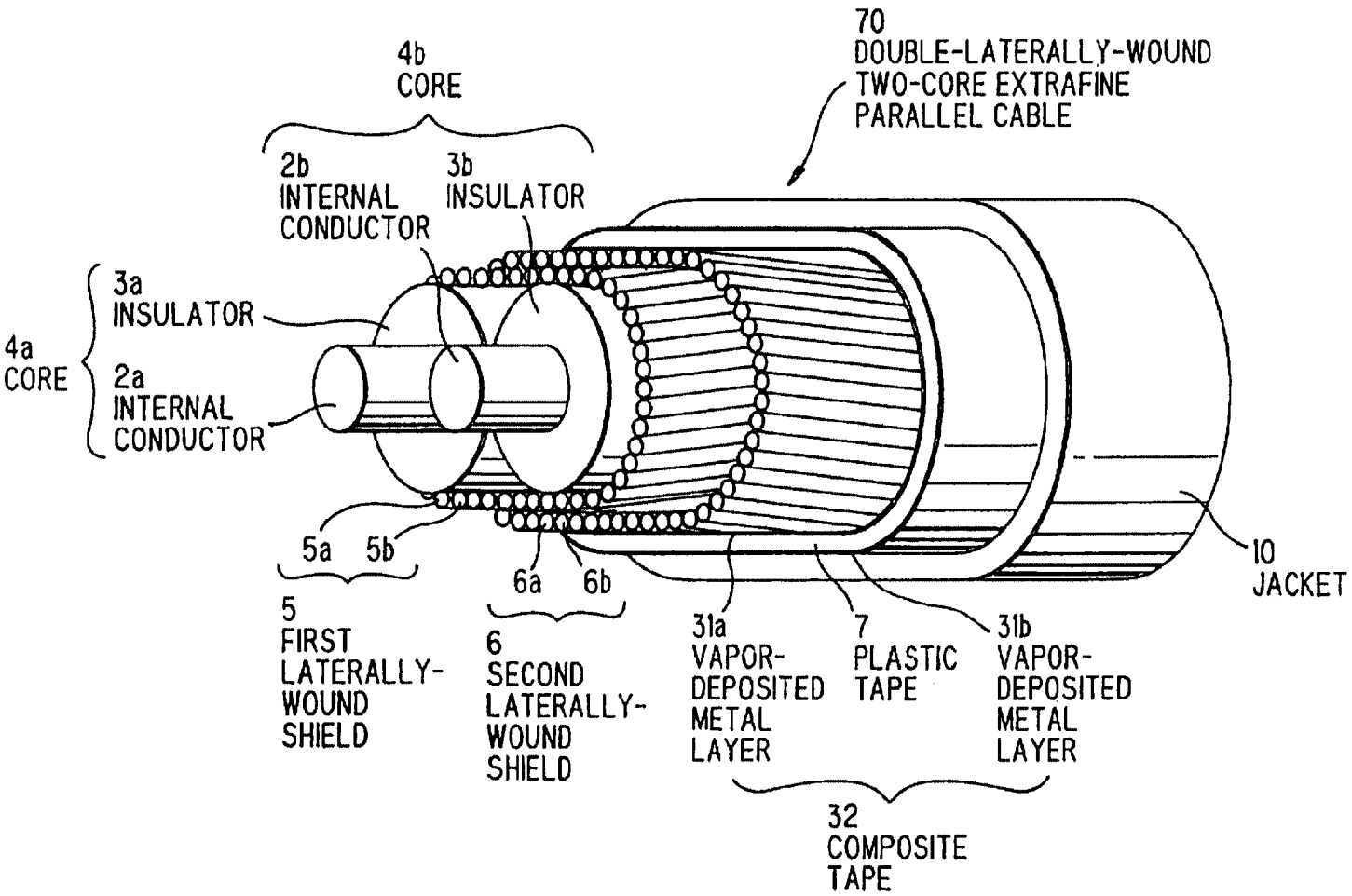
FIG. 8 is a structural view of the double-laterally-wound two-core parallel extrafine coaxial cable shown in FIG. 7.

FIG. 7 shows a sectional view of a double-laterally-wound two-core parallel extrafine coaxial cable as a fourth embodiment of the present invention. FIG. 8 shows a structural view of the double-laterally-wound two-core parallel extrafine coaxial cable shown in FIG. 7.

As shown in FIGS. 7 and 8, the double-laterally-wound two-core parallel extrafine coaxial cable 70 is arranged similarly to the double-laterally-wound two-core parallel extrafine coaxial cable 50 described in FIGS. 5 and 6 except that the composite tape 32, which is composed of the plastic tape 7 having the vapor-deposited metal layers 31*a* and 31*b* formed on both the surfaces thereof, is wound around the outer periphery of the second laterally-wound shield 52.

The vapor-deposited metal layers 31*a* and 31*b* are composed of, for example, copper or silver and have a thickness of at least 0.1 μm.

Since the double-laterally-wound two-core parallel extrafine coaxial cable 70 has the composite tape 32 that has the vapor-deposited metal layers 31*a* and 31*b* formed on both the surfaces thereof and is wound around the outer periphery thereof, the cable 30 has an advantage that the shield effect can be more enhanced than the cable 50. Further, since it is not necessary to confirm the front surface and the back surface of the composite tape 32 when it is wound around the outer periphery of the second laterally-wound shield 52, the cable 30 also has an advantage for preventing the composite tape 32 from being erroneously wound. The other operation/working-effect of the cable 70 is the same as that of the cable 50.

Next, the features of the double-laterally-wound two-core parallel extrafine coaxial cables according to the present invention will be summarized below.

Table 1 compares the double-laterally-wound two-core parallel extrafine coaxial cables according to the present invention with conventional two-core parallel extrafine coaxial cables as to the shield effect, the shield strip property, and the bending characteristics. The conventional cables include two examples one of which is a cable having a braided shield and the other of which is a cable having one layer laterally-wound shield. In Table 1, an optimal shield is denoted by "◎" symbol, an more than adequate shield is denoted by "○" symbol, a adequate shield is denoted by "Δ" symbol, and an inadequate shield is denoted by "X" symbol.

TABLE 1

| Shield | Shield effect | Shield strip property | Bending characteristics |
|---|---|---|---|
| Braided shield | ◎ | X | X |
| Laterally-wound shield (one-layer) | Δ | ◎ | ◎ |
| Laterally-wound shield (two-layer: same direction) | ○ | ◎ | ○ |
| Laterally-wound shield (two-layer: opposite directions) | ◎ | ○ | Δ |

As shown in Table 1, the cable using the braided shield of the conventional example is poor in the shield strip property and the bending characteristics while it is excellent in the shield effect because it has a large metal volume. The cable using the one-layer laterally-wound shield of the conventional example has such a structure that the laterally-wound shield is composed of a plurality of shield wires wound spirally. Thus, the cable is excellent in the shield strip property and the bending characteristics. However, the cable is poor in the shield effect because the metal volume thereof is smaller than that of the cable using the braided shield and thus a continuous slit is formed between wires.

In contrast, the double-laterally-wound two-core parallel extrafine coaxial cables according to the present invention to which the two-layer laterally-wound shields are applied in the opposite directions, that is, the cables 1 and 30 described in FIG. 1 to FIG. 4 can exhibit the shield effect as high as that of the external shield composed of the braided shield because the slits formed between the shield wires can be minimized. Further, since the laterally-wound shields can be easily untied, the coaxial cables are excellent also in the shield strip property. The cables have the bending characteristics superior to that of the coaxial cable having the braided shield because the two-later laterally-wound shields are applied in the opposite directions, while they are inferior to those of the one-layer laterally-wound shield.

The double-laterally-wound two-core parallel extrafine coaxial cables according to the present invention to which the two-layer laterally-wound shields are applied in the same direction, that is, the cables 50 and 70 described in FIG. 5 to FIG. 8 are excellent particularly in the shield strip property and the bending characteristics because the two-layer laterally-wound shields are applied in the same direction, while they are somewhat inferior to the cables to which the two-layer laterally-wound shields are applied in the opposite directions in the shield strip property.

Therefore, it can be found that the double-laterally-wound two-core parallel extrafine coaxial cables according to the present invention has all of the shield effect, the shield strip property, and the bending characteristics in good balance.

As apparent from the above description, the present invention exhibits the following excellent effects.

(1) Since the external shields are composed of the double-laterally-wound shields, the coaxial cables are excellent in the bending characteristics, the shield effect, and the shield strip property.

What is claimed is:

1. A double-laterally-wound two-core parallel extrafine coaxial cable, comprising:

two cores having internal conductors whose outer peripheries are covered with insulators and disposed in parallel with each other;

a first laterally-wound shield applied to the outer periphery of the two cores;

a second laterally-wound shield applied to the outer periphery of the first laterally-wound shield in a direction opposite to that of the first laterally-wound shield;

a composite tape, which comprises a plastic tape having a vapor-deposited metal layer formed on one surface thereof, wound around the outer periphery of the second laterally-wound shield such that the vapor-deposited metal layer faces the second laterally-wound shield; and a jacket covering the outer periphery of the composite tape;

wherein each of the cores has a core outer diameter, the laterally-wound shields are formed of wire having a wire diameter, and the pitch of the lateral winding of the laterally wound shields is 10 to 20 times the sum of twice the core outer diameter and twice the wire diameter.

2. A double-laterally-wound two-core parallel extrafine coaxial cable 1 according to claim 1, wherein the internal conductors of the cores have an outside diameter of about 0.13 mm or less and an outside diameter of 1.0 mm or less in a long axis direction when the cable is covered with the jacket.

3. A double-laterally-wound two-core parallel extrafine coaxial cable according to claim 1, wherein vapor-deposited metal layer formed on the composite film comprises one of silver and copper and has a thickness of 0.1 $\mu$m or more.

4. A double-laterally-wound two-core parallel extrafine coaxial cable, comprising:

two cores having internal conductors whose outer peripheries are covered with insulators and disposed in parallel with each other;

a first laterally-wound shield applied to the outer periphery of the two cores;

a second laterally-wound shield applied to the outer periphery of the first laterally-wound shield in a direction opposite to that of the first laterally-wound shield;

a composite tape, which comprises a plastic tape having vapor-deposited metal layers formed on both the surfaces thereof, wound around the outer periphery of the second laterally-wound shield; and a jacket covering the outer periphery of the composite tape;

wherein each of the cores has a core outer diameter, the laterally-wound shields are formed of wire having a wire diameter, and the pitch of the lateral winding of the laterally wound shields is 10 to 20 times the sum of twice the core outer diameter and twice the wire diameter.

5. A double-laterally-wound two-core parallel extrafine coaxial cable, comprising:

two cores having internal conductors whose outer peripheries are covered with insulators and disposed in parallel with each other;

a first laterally-wound shield applied to the outer periphery of the two cores;

a second laterally-wound shield applied to the outer periphery of the first laterally-wound shield in the same direction as that of and at a pitch different from that of the first laterally-wound shield;

a composite tape, which comprises a plastic tape having a vapor-deposited metal layer formed on one surface thereof, wound around the outer periphery of the second laterally-wound shield such that the vapor-deposited metal layer faces the second laterally-wound shield; and a jacket covering the outer periphery of the composite tape;

wherein each of the cores has a core outer diameter, the laterally-wound shields are formed of wire having a wire diameter, and the pitch of the lateral winding of the laterally wound shields is 10 to 20 times the sum of twice the core outer diameter and twice the wire diameter.

6. A double-laterally-wound two-core parallel extrafine coaxial cable, comprising:

two cores having internal conductors whose outer peripheries are covered with insulators and disposed in parallel with each other;

a first laterally-wound shield applied to the outer periphery of the two cores;

a second laterally-wound shield applied to the outer periphery of the first laterally-wound shield in the same direction as that of and at a pitch different from that of the first laterally-wound shield;

a composite tape, which comprises a plastic tape having vapor-deposited metal layers formed on both the surfaces thereof, wound around the outer periphery of the second laterally-wound shield; and a jacket covering the outer periphery of the composite tape;

wherein each of the cores has a core outer diameter, the laterally-wound shields are formed of wire having a wire diameter, and the pitch of the lateral winding of the laterally wound shields is 10 to 20 times the sum of twice the core outer diameter and twice the wire diameter.

* * * * *